US007721910B2

(12) United States Patent
Wallace

(10) Patent No.: US 7,721,910 B2
(45) Date of Patent: May 25, 2010

(54) PAINT TRAY AND METHOD FOR MANUFACTURE

(76) Inventor: Millard F. Wallace, 555 Ridge Rd., Orwigsburg, PA (US) 17961

( * ) Notice: Subject to any disclaimer, the term of this patent is extended or adjusted under 35 U.S.C. 154(b) by 0 days.

(21) Appl. No.: 11/734,285

(22) Filed: Apr. 12, 2007

(65) Prior Publication Data

US 2007/0246474 A1 Oct. 25, 2007

Related U.S. Application Data

(60) Provisional application No. 60/794,409, filed on Apr. 24, 2006, provisional application No. 60/855,597, filed on Oct. 31, 2006.

(51) Int. Cl.
*B05C 21/00* (2006.01)

(52) U.S. Cl. ..... 220/570; 220/495.01; 220/495.02

(58) Field of Classification Search ..... 220/570, 220/571.1, 495.01, 495.02, 573.4
See application file for complete search history.

(56) References Cited

U.S. PATENT DOCUMENTS 2,542,413 A * 2/1951 Ibsch, Jr. ..... 220/574.3
2,838,781 A * 6/1958 Molle ..... 15/257.06
2,922,176 A 1/1960 Bernhardt
3,148,799 A * 9/1964 Meroney ..... 220/495.11
3,348,243 A * 10/1967 Kelly ..... 4/244.3
3,380,100 A 4/1968 Pharris
3,514,012 A * 5/1970 Martin ..... 220/570
3,579,669 A * 5/1971 Loewenstein ..... 4/244.3
3,698,594 A * 10/1972 Boehlert ..... 220/495.01
3,757,990 A * 9/1973 Buth ..... 220/570
4,010,866 A * 3/1977 McClane ..... 220/570
4,182,462 A * 1/1980 Buff, Jr. ..... 220/495.03
4,525,880 A * 7/1985 Bass ..... 4/239
4,765,123 A * 8/1988 Caldwell ..... 53/459
4,798,130 A * 1/1989 Dixon ..... 454/164
4,828,134 A * 5/1989 Ferlanti ..... 220/573.1
4,944,427 A * 7/1990 Yamada et al. ..... 220/495.01
D319,518 S 8/1991 Abel
5,061,532 A * 10/1991 Yamada ..... 428/35.7
5,178,293 A * 1/1993 Suzuki et al. ..... 220/359.3
5,411,167 A * 5/1995 Weder ..... 220/62.11
5,445,110 A * 8/1995 Birnie ..... 119/61.5
5,460,289 A * 10/1995 Gemmell ..... 220/495.02
5,501,360 A * 3/1996 Weder ..... 220/62.11
5,503,293 A * 4/1996 Weder ..... 220/62.11
5,632,130 A * 5/1997 Weder et al. ..... 53/397
5,653,089 A * 8/1997 Weder ..... 53/397
5,681,625 A * 10/1997 Weder et al. ..... 428/34.1

(Continued)

*Primary Examiner*—Anthony Stashick
*Assistant Examiner*—Christopher B McKinley
(74) *Attorney, Agent, or Firm*—Flaster Greenberg, P.C.; Gary D. Colby

(57) ABSTRACT

A preformed paint tray with peelable liners is made from a planar tray substrate with upper and lower surfaces and a plurality of stacked liner sheets with peelable adhesive on one surface by positioning the liner sheets adjacent a surface of the substrate, and simultaneously thermoforming the substrate and sheets together to form a substrate having a shaped interior, with the sheets conforming to the shaped interior of the substrate. The sheets are maintained in the thermoformed shape by their adherence to the other sheets and the substrate. If desired, the sheets can include tear tabs to facilitate separation of the top sheet from the other sheets. The tray can be cleaned of residual paint after use by simply peeling away the upper liner sheet.

13 Claims, 5 Drawing Sheets

U.S. PATENT DOCUMENTS 5,727,708 A 3/1998 Erickson
5,782,057 A * 7/1998 Weder ..... 715/781
5,816,501 A 10/1998 LoPresti
5,966,772 A * 10/1999 Woodnorth et al. ..... 15/230.11
5,975,299 A * 11/1999 Weder et al. ..... 206/423
6,041,450 A * 3/2000 Akazawa ..... 4/244.1
6,058,518 A * 5/2000 Akazawa ..... 4/245.4
6,196,410 B1 * 3/2001 Hocking ..... 220/495.02
6,276,554 B1 8/2001 Lallement
D448,130 S 9/2001 Wagner
6,434,782 B2 * 8/2002 Wakat et al. ..... 15/257.06
6,471,086 B1 * 10/2002 Fleckenstein ..... 220/570
6,679,398 B1 1/2004 O'Brien
6,761,011 B2 * 7/2004 Weder et al. ..... 53/397
6,851,570 B2 * 2/2005 Janssen ..... 220/570
7,004,348 B2 * 2/2006 Hong ..... 220/570
D569,567 S * 5/2008 Kohn ..... D32/53.1
2001/0013518 A1 * 8/2001 Lallement et al. ..... 220/570
2002/0193031 A1 * 12/2002 Stell ..... 442/378
2003/0064181 A1 * 4/2003 Ingraham ..... 428/35.2
2003/0074760 A1 * 4/2003 Keller ..... 15/230.11
2004/0112902 A1 * 6/2004 Campbell ..... 220/570
2004/0126524 A1 * 7/2004 Longo et al. ..... 428/36.5
2004/0134917 A1 * 7/2004 Carnegie ..... 220/570
2004/0145196 A1 * 7/2004 Katz ..... 294/1.4
2004/0168954 A1 * 9/2004 Hannan et al. ..... 206/594
2006/0037960 A1 * 2/2006 Rosa ..... 220/495.02
2006/0059747 A1 * 3/2006 Wescott et al. ..... 40/594
2007/0199942 A1 * 8/2007 Thom et al. ..... 220/570

* cited by examiner

PAINT TRAY AND METHOD FOR MANUFACTURE

This application claims the benefit of the filing dates of U.S. Provisional Application Ser. No. 60/794,409, filed Apr. 24, 2006, and U.S. Provisional Application Ser. No. 60/855,597, filed Oct. 31, 2006.

FIELD OF THE INVENTION

The present invention relates generally to a paint tray for use in applying paint to a surface with a paint roller, and in particular to a paint tray having a plurality of layers of a peelable surfacing film, whereby the paint tray can be cleaned after use by peeling away the upper film surface. The invention also relates to a method for converting multi layers of material into a roll and forming the paint tray with adhered layers. Also the method could lend itself to a number of other markets other than paint trays, i.e., trashcans, buckets, metal paint trays, cat litter containers, camping plates, medical trays, etc.

BACKGROUND OF THE INVENTION

Paint is commonly applied to walls and other surfaces with a paint roller comprised of a roll of napped textile material or other paint absorbent substrate carried on a handle, and a metal or plastic paint-holding tray into which the roller is placed to load the roll with paint. While useful in quickly applying a uniform paint coating to large surfaces, a major disadvantage of the use of this system is the required messy and time consuming chore of cleaning the roller and tray after use. The present application relates to an improved tray that enables the user to avoid tray cleaning, and to a tray with two wells divided by a flat section designed specifically to properly distribute paint on the roller nap. The tray configuration is also designed to lend itself to thermoforming.

In an attempt to minimize cleaning, the prior art describes a preformed paint tray liner that is placed into the interior of a paint tray. Generally, these liners are thermoformed from a plastic sheet having a thickness of from about 0.008 to about 0.03 inches. The paint is poured into this liner, which is removed and discarded along with any adhered paint after the paint job is completed. While effective in eliminating the need to clean the paint tray, these preformed liners are sufficiently expensive that many users attempt to clean and reuse the liners. Their thickness adds significantly to environmental waste upon disposal. The preformed tray liners also require separate additional storage prior to use.

Other prior art as exemplified by U.S. Published Apn. No. 2004/0112902 to Campbell and U.S. Published Apn. No. 2006/0037960 to Rosa manually presses an impervious plastic sheet having a thickness of from about 0.5 to about 5 mils and an adhesive backing into a previously formed paint tray so that the sheet approximately conforms to the tray. The sheet is peeled away and discarded after use. While less expensive than preformed tray liners, these sheets are awkward and time consuming to individually hand press into place and do not provide a functional liner that exactly conforms to the tray interior, especially in the corners of the tray.

Thus, there is a continuing need for a paint tray having a properly fitted, factory applied, functional, disposable liner that avoids the necessity of cleaning the paint tray after every use. There is a further need for a method of manufacturing a paint tray with a plurality of disposable liners and a method of manufacturing a plurality of formed trays more efficiently.

SUMMARY OF THE INVENTION

Generally, the present invention is comprised of a paint tray with a plurality of peelable liners that are simultaneously thermoformed with the tray, with the liners being thermoformed to the shape of the tray interior surface at the same time the tray is formed. As used herein, the term "thermoformed" is intended to encompass various methods of shaping a thermoplastic sheet or stacked sheets by heating the sheet and applying a pressure differential to the opposed side of the sheet to conform the sheet to the shape of a mold surface.

While the invention will be described in terms of the preferred embodiment of simultaneously thermoforming a substrate and a plurality of liner sheets or simultaneously thermoforming a plurality of similar thin wall substrates with a release agent/barrier on the inner or bottom surface, it will be understood after reading the disclosure that the invention is also applicable to simultaneously forming a substrate and a single liner sheet, and to shaping the liner sheets and substrate by other means, e.g., by stamping, injection molding or blow molding. The substrate, while preferably a thermoformable plastic, may also be of other materials, e.g., metals.

In one example of thermoforming known as vacuum molding, a sheet is positioned adjacent a female mold section and a vacuum is applied to draw the sheet against the mold surface. A male mold section may be pressed against the sheet on the opposite side of the sheet from the female mold section to assist in conforming the sheet to the shape of the female mold section. In other processes, such as pressure forming, the heated sheet is pressed against a male mold section, usually with the assistance of a vacuum to conform the sheet to the mold shape.

In a preferred embodiment of the present invention, a plurality of stacked planar sheets of thin plastic serving as disposable liners ("liner sheets") are positioned on a surface of a planar substrate sheet of a greater thickness to be formed into a paint tray. The combination of a stack of liner sheets and a single substrate makes a "tray sheet". The liner sheets will preferably be significantly thinner than the substrate sheet, e.g., the liner sheets may be from about 1 mil to about 6 mils thick, while the substrate sheet may be from about 10 mils to about 40 mils thick.

Each liner sheet has an adhesive on its inner or bottom surface to secure the liner sheets to the immediately adjacent sheet, with the innermost or bottom liner sheet being adhered to the top surface of the substrate sheet. Preferably, the adhesive backing is a uniform coating of adhesive over the entire inner surface of the sheets except where tear tabs are located. While applying the adhesive in making the liner sheets, the tabs can be added in line, anywhere in part or whole around the perimeter of where the tray will be formed. This is done by deadening the adhesive. Tabs are applied to each liner sheet to facilitate separation of the sheets. Suitable adhesives will be apparent to one skilled in the art, the requirement being that the adhesive is a peelable adhesive, i.e., an adhesive that will permit separation of one liner sheet from another liner sheet or the substrate without tearing the liner sheet.

The tray sheets can be shipped in either sheet form or roll form. For convenience in shipping, storage, and thermoforming, the tray sheet may be provided to the thermoformer in a continuous roll form ("master pad roll"). The roll can be continuously fed through the thermoformer, with each length of tray sheet being indexed, then thermoformed into a shape, i.e. paint tray. The roll length and width can be as desired. For example, the master pad roll can be 5" to 48" in width.

The combined stack of sheets (tray sheets), is thermoformed as a unit into the shape of the desired product, e.g., a paint tray with the liner sheets being on the interior of the paint tray. Upon cooling, the tray sheet maintains its thermoformed configuration due to the thickness of the substrate sheet, while the configuration of the liner sheets is assisted by the presence of the adhesive backing.

The paint tray is used like one would use an ordinary paint tray that does not have a liner. However, unlike the prior art trays described above, there is no need to place a preformed liner into the tray or attempt to hand shape a sheet of thin plastic to conform to the tray interior. After use, the upper liner sheet can be simply peeled away along with the paint residue, exposing the next liner sheet as a clean paint tray ready for use.

The mold, and thereby the thermoformed tray system, can be of various shapes. Generally, the resultant tray will have an open-top interior cavity with a floor and continuous side walls. The paint tray may include at least one paint well and a flat section, normally ridged, for removal of excess paint from a roller dipped into paint within the paint well. In a preferred embodiment, the improved tray may be comprised of two paint wells divided by a horizontal, flat central section so that paint can be placed in both wells. The flat section is connected to opposed ramps tapering upwardly from the paint wells.

In another embodiment of the invention, multiple containers such as plastic egg cartons, cookie trays (e.g., Oreo), jello containers, blister packs, rigid paint tray liners etc., are produced by simultaneously thermoforming multiple layers of plastic sheets having the same thickness. Sheets used in this application are generally from about 0.006" to about 0.025" thick. Preferably, a stack of sheets, e.g., from 4 to 6 sheets, are provided to the thermoformer in roll form. A release agent, e.g., a coating, adhesive barrier or release film is applied between the sheets to prevent the sheets from melting/bonding together during the thermoforming process, and to allow the finished containers to be separated easily (e.g., a form of silicone may be introduced between the layers of sheets. A zone coat of adhesive (e.g., 1 inch wide) may be applied along the edge of the substrate to allow for easier transport of the rolls of substrates and sheets by keeping the material together in roll form more effectively. Stacks of sheets are thermoformed by being drawn or pressed into a mold having the desired cavity shape.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
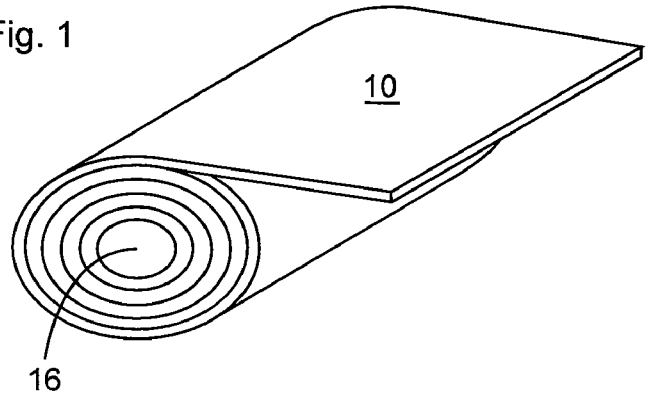
FIG. 1 is a perspective view of a roll of stacked liner sheets and a substrate sheet (master PAD roll) ready for thermoforming.
Figure 5:
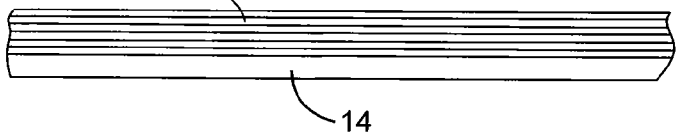
FIG. 5 is a detailed sectional side view of a segment of a stack of liner sheets and a substrate sheet.

As illustrated in FIGS. 1 and 5, tray sheet 10, comprised of a plurality of liner sheets 12 and a bottom substrate sheet 14, is shipped to the thermoformer as a roll 16.

Figure 2:
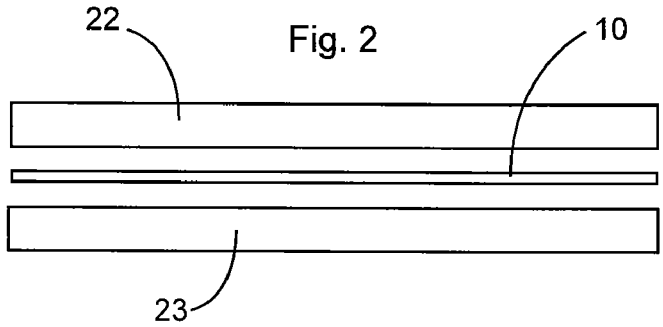
FIG. 2 is a sectional side view of a tray sheet section positioned between heaters prior to thermoforming.
Figure 3:
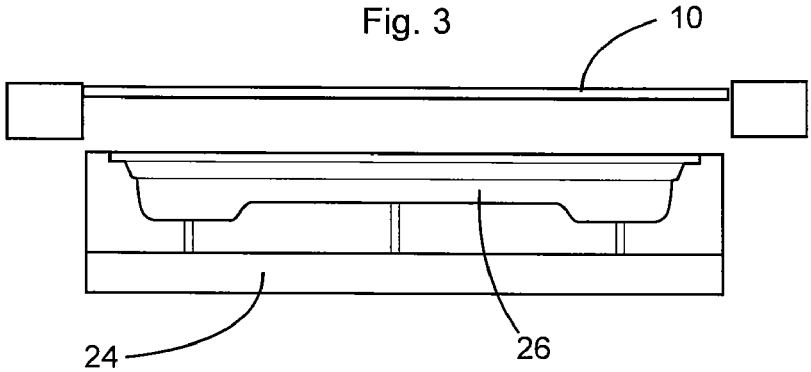
FIG. 3 is a sectional side view of a heated tray sheet section positioned in a thermoforming apparatus prior to thermoforming.
Figure 4:
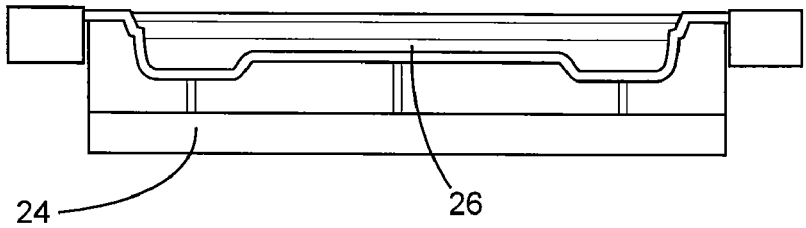
FIG. 4 is a sectional end view of a thermoformed tray system prior to ejection from the thermoforming apparatus.

As illustrated in FIG. 2, tray sheet 10 is pulled via the thermoforming machine from roll 16 and positioned within a thermoforming apparatus comprised of upper and lower heaters 22 and 23 to heat the sheet to a moldable state. While both ovens can be heated simultaneously, they also may need to be adjusted independently of one another. The heated sheet is then pulled further to a position over a vacuum source 24 as illustrated in FIG. 3. A female mold 26 conforming to the desired shape of the tray system is positioned in communication with vacuum source 24. Heated sheet segment 10 is lowered onto mold 26 and a vacuum is drawn on mold 26 with vacuum source 24, shaping sheet segment 10 to the interior contours of mold 26 as shown in FIG. 4. The molded tray system is then cooled and ejected from mold 26, and edge trimmed if desired.

The resultant product is a thermoformed tray system comprised of a substrate sheet in the shape of the desired tray, with a plurality of liner sheets stacked thereon and held in place by adhesive layers, both natural or man made, between the liner sheets and the lowermost liner sheet and the upper surface of the substrate sheet. All sheets are molded into the shape of the desired tray.

Figure 6:
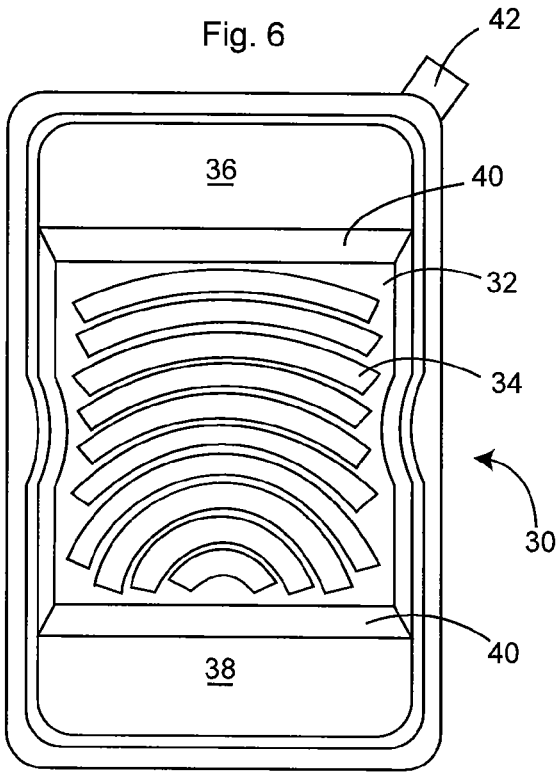
FIG. 6 is a top view of a preferred tray system.
Figure 7:
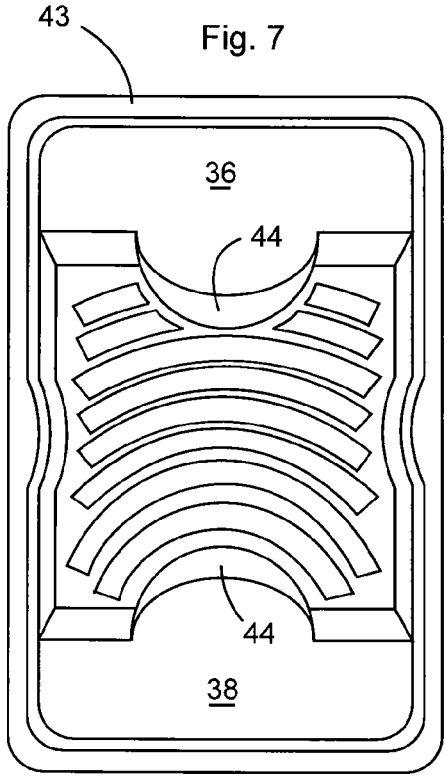
FIG. 7 is a top view of an alternative preferred tray system.

A preferred tray 30 is illustrated in FIG. 6. Tray 30 is comprised preferably of a horizontal, flat central shelf 32 with ridges 34 to remove excess paint from a paint roller rolled across shelf 32, down ramps 40 and paint wells 36 and 38 on opposite sides of ramps 40. Tear tab 42 can be located anywhere on the perimeter of all liner sheets, or all or part of the entire perimeter of the liner sheet can form a tab 43 for use in separating the liners. An alternative tray configuration is illustrated in FIG. 7, showing the addition of feet 44 for added stability.

Figure 8:
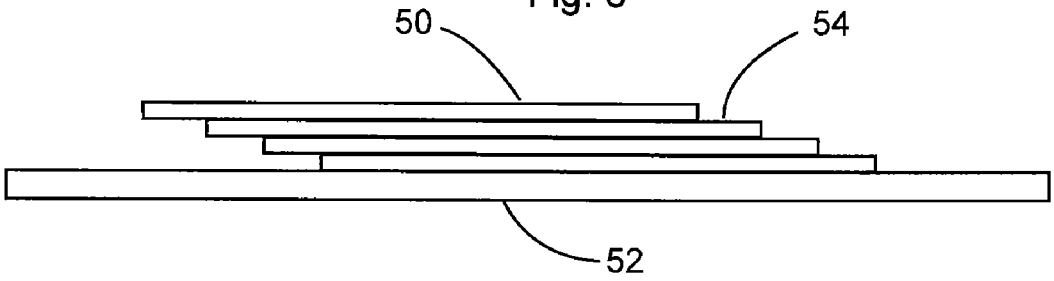
FIG. 8 is a side view of an alternative tear tab assembly.

Various other means may be used to include tabs to facilitate separation of the tapes. For example, as shown in FIG. 8, the layers of liner sheets 50 may be stepped during the converting process where the substrate 52 and liner sheets 50 are formed into a roll. The resulting look will be like steps 54 on the edges, allowing the consumer to see the edges of all the layers.

Figure 9:
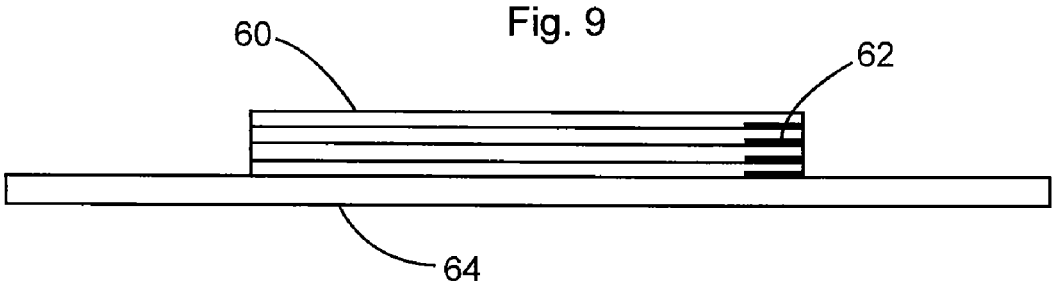
FIG. 9 is a side view of another alternative tear tab assembly.

In another alternative shown in FIG. 9, the liner sheets 60 may be "strip coated" before it is made into the roll form. That is, adhesive is applied to the body of the liner sheets 60, except for the area of the tabs 62. Thus, the liner sheets 60 have adhesive except for the edges (e.g., ½"), either on one side or both sides of the liner sheets. The end result is the edges of the paint tray will have no adhesive on the "tabs" 62, allowing the consumer to identify and begin peeling the layers.

Figure 10:
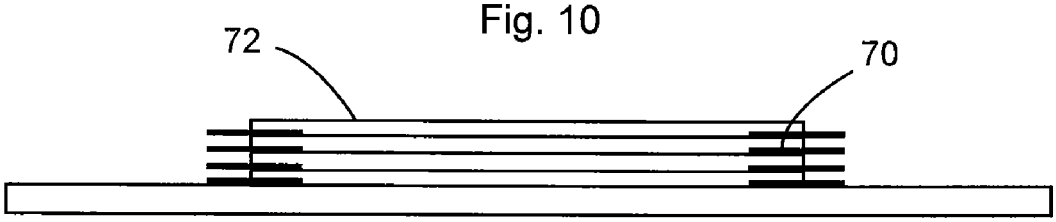
FIG. 10 is a side view of yet another alternative tear tab assembly.

Yet another alternative as shown in FIG. 10, is to use actual separate tabs 70 on the edges of the liner sheets 72 to distinguish between layers. The separate tabs 70 could be tape/film of plastic or paper (e.g. ¾" wide, with or without adhesive) to be applied on the ends of the protective tape on either the top or bottom preferably the bottom (this side of the protective tape has the adhesive). This tape/film could be of various colors and designs and will serve as an aid for the consumer to pull apart the layers of liner sheets 72.

Figure 11:
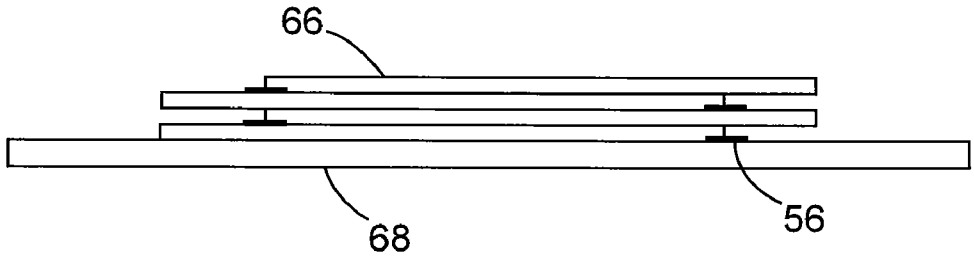
FIG. 11 is a side view of yet another tear tab assembly.

Yet another alternative is shown in FIG. 11, using actual separate tabs 56 on the edges of the liner sheets 66 to distinguish between layers, however tabs 56 are applied on opposing edges of sequencing liner sheets 66, while liner sheets 66 are shifted, creating a pitter patter effect with tabs 56 hidden underneath top liner sheets 66 until top layer is removed. The separate tabs 56 could be tape/film of plastic or paper (e.g. ¾" wide, with or without adhesive) to be applied on the ends of the protective tape on either the top or bottom, preferably the bottom (this side of the protective tape has the adhesive). This tape/film could be of various colors and designs and will serve as an aid for the consumer to pull apart the layers of liner sheets 66.

Figure 12:
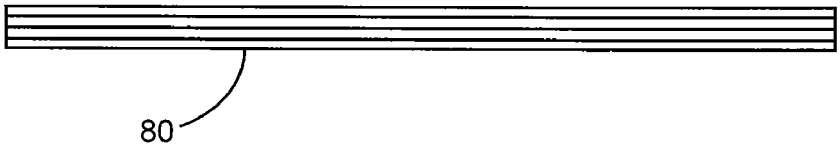
FIG. 12 is a side view of a pad of liner sheets.
Figure 13:
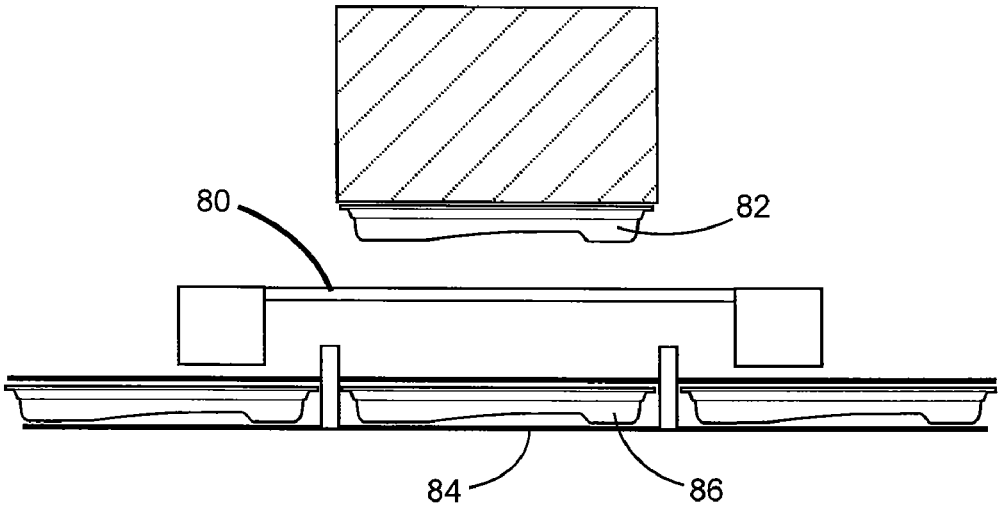
FIG. 13 is a sectional side view of a stamping apparatus and a pad of liner sheets.

While the invention is described primarily in terms of the manufacture of a paint tray with a stack of thermoformed sheet liners conforming to the interior dimensions of the paint tray, it will be apparent that the broad concept of the invention can be modified for other applications. For example, as illustrated in FIGS. 12 and 13, instead of simultaneously shaping the substrate that forms the tray or other product and the liner sheets, the substrate can be initially formed into the tray, or the tray can be otherwise manufactured. A pad of liner sheets 80 can then be formed within the tray. That is, a mold of the image of the product, e.g., paint tray 82, is suspended above the product (e.g. paint tray in plastic or metal) and sandwiched in between is a continuous roll of liner sheets 80. The paint tray will be moving along a conveyor 84 and when the paint tray is nested opposing the mold image of the product 86, the two parts are "stamped" together, thus creating the finished product with the pads of liner sheets.

Figure 14:
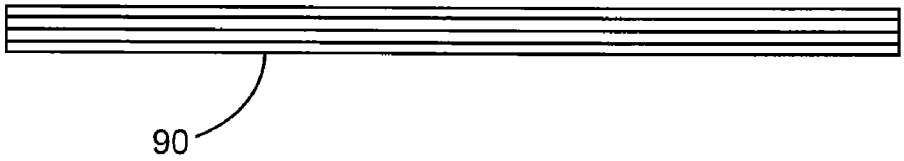
FIG. 14 is a side view of a stack of substrate and sheets.
Figure 15:
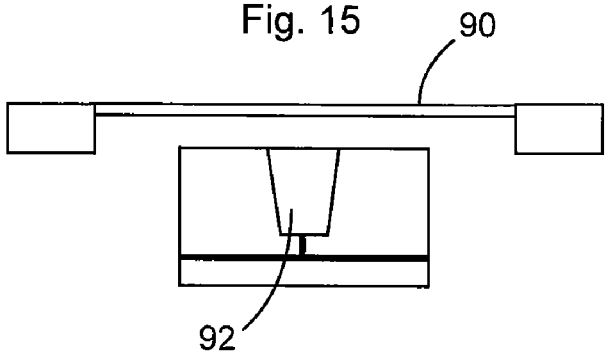
FIG. 15 is a sectional side view of a stack of substrate and sheets in preparation for molding into a female cavity mold.
Figure 16:
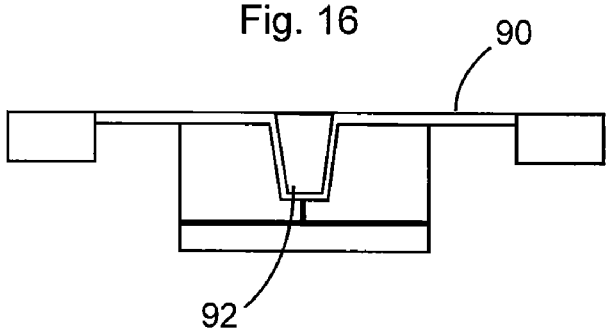
FIG. 16 is a sectional side view of a stack of substrate and sheets molded into a female cavity mold.

In another alternative illustrated in FIGS. 14-16, multiple layers of plastic sheets 90 having the same thickness, instead of liner sheets/protective tape, can be thermoformed simultaneously, in order to make multiple products. Applied applications for this would be various containers such as plastic egg cartons, cookie trays (e.g., Oreo), Jello containers, blister packs, rigid paint tray liners etc. The substrate is a more rigid material, while the liner sheets/protective tape is more stretchable and pliable, such as a garbage bag. The plastic sheets 90 in this process are of a lesser thickness than the paint tray of 0.030", but not as thin as the liners of protective tape.

This latter process ideally uses about 3 to 6 layers in roll form. Currently the maximum thickness to thermoform (in roll form) effectively is around 0.050". A coating, adhesive barrier, release agent, or film will be applied to or placed in between the sheets where needed and in any combination to prevent the sheets from melting/bonding together in the thermoforming process, and for allowing the finished products to be separated easily (e.g., a form of silicone may be introduced between the layers of sheets while a zone coat of adhesive (e.g., 1 inch wide) may be applied along the edge of the substrate). This adhesion allows for easier transport of the roll of sheets by keeping the material together in roll form more effectively. Multiple sheets of approximate thickness 0.010" each are stacked together with a barrier/adhesion between each layer. The multi-sheet layers are rolled together and then sold to various thermoforming companies. Ultimately time and money are saved by the thermoformers, allowing them to be more efficient. Sheets 90 are thermoformed by being drawn or pressed into a mold 92 having the desired cavity shape.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A paint tray comprising:

a) a tray-shaped substrate having a top side including a concave interior surface and a bottom side for supporting the paint tray when it rests on a supporting surface; and b) a plurality of peelable liner sheets including a bottom sheet, each sheet conforming to the shape of the top side, including substantially the entire interior surface, and having a lower surface and an upper surface, the lower surface of each sheet other than the bottom sheet being releasibly adhered to the upper surface of the underlying sheet with a peelable adhesive on substantially the entire lower surface of the sheet, the lower surface of the bottom sheet being releasibly adhered to the interior surface with a peelable adhesive on substantially the entire lower surface of the bottom sheet.

2. The paint tray of claim 1, wherein the bottom sheet is not adhered to any portion of the bottom side of the substrate.

3. The paint tray of claim 1, wherein the bottom sheet comprises a tab that is not adhered to the substrate.

4. The paint tray of claim 3, wherein the peelable adhesive adheres the entirety of the lower surface of the bottom sheet, other than the tab, to the interior surface.

5. The paint tray of claim 3, wherein each of the sheets comprises a tab that is not adhered to the surface underlying the tab.

6. The paint tray of claim 1, wherein the substrate is a thermoformed plastic.

7. The paint tray of claim 1, having at least three peelable liner sheets.

8. The paint tray of claim 1, having at least five peelable liner sheets.

9. The paint tray of claim 1, wherein each of the substrate and the sheets is a thermoformed plastic.

10. The paint tray of claim 1, wherein the substrate is made from a different material than the sheets.

11. The paint tray of claim 1, wherein each of the sheets comprises a tab that is not adhered to the substrate or to the upper surface of any other sheet.

12. The paint tray of claim 1, wherein the shape of the interior surface includes two paint wells divided by a flat section.

13. The paint tray of claim 1, further comprising feet on the bottom side of the paint tray.

* * * * *